US005716022A

United States Patent [19]

Chiloff

[11] Patent Number: 5,716,022

[45] Date of Patent: Feb. 10, 1998

[54] DEVICE FOR POSITIONING AND SPLICING ROLLS OF PAPER SHEETS AND THE LIKE

[75] Inventor: Serge Chiloff, Olivet, France

[73] Assignee: Societe d'Etude de Machines pour les Arts Graphiques, Alpes Maritimes, France

[21] Appl. No.: 576,680

[22] Filed: Dec. 21, 1995

[30] Foreign Application Priority Data

Dec. 22, 1994 [FR] France ..... 94 15478

[51] Int. Cl.[6] ..... B65H 19/12

[52] U.S. Cl. ..... 242/552; 242/557; 242/559

[58] Field of Search ..... 242/552, 554.6, 242/557, 558, 559, 560, 560.1, 560.2, 561, 597, 597.1, 597.2, 597.3, 597.8, 598, 598.1, 598.5; 156/502, 504, 507

[56] References Cited

U.S. PATENT DOCUMENTS

| | | | |
|---|---|---|---|
| 3,891,158 | 6/1975 | Shearon . | |
| 3,995,758 | 12/1976 | Kovaleski | 242/597.1 |
| 4,132,371 | 1/1979 | Byrt | 242/559 |
| 4,194,701 | 3/1980 | Andreasson | 156/502 |
| 4,949,910 | 8/1990 | Kleitz et al. | 242/552 |
| 5,285,976 | 2/1994 | Schmid et al. | 242/557 |

FOREIGN PATENT DOCUMENTS

| | | | |
|---|---|---|---|
| 1012947 | 6/1977 | Canada | 242/597.3 |
| 0301989 | 2/1989 | European Pat. Off. . | |
| 0321887 | 6/1989 | European Pat. Off. . | |
| 0519666 | 12/1992 | European Pat. Off. . | |
| 2078600 | 11/1971 | France . | |
| 2207496 | 6/1974 | France . | |
| 2621901 | 4/1989 | France . | |
| 1 265 525 | 4/1968 | Germany | 242/598.1 |
| 3731748 | 4/1989 | Germany . | |
| 4206330 | 9/1993 | Germany . | |
| 618157 | 8/1978 | U.S.S.R. | 242/559 |
| 10121 | of 1913 | United Kingdom . | |

*Primary Examiner*—John P. Darling
*Attorney, Agent, or Firm*—Dougherty & Dremann

[57] ABSTRACT

A positioning and splicing device for paper rolls having at least one carriage arranged to be movable along guides and having an upright on one side provided with slide members for guiding a second carriage that is axially movable along the upright. The second carriage is provided with a spindle for engaging a roll. The roll is raised by a movement of the spindle protruding from the roll and the carriage is moved into engagement in a rotary coupling element that is fixedly mounted, so that the spindle is supported at both ends when the sheet is un-wound from the roll.

13 Claims, 2 Drawing Sheets

DEVICE FOR POSITIONING AND SPLICING ROLLS OF PAPER SHEETS AND THE LIKE

FIELD OF THE INVENTION

The invention relates to apparatus for the unwinding of rolls of sheets or webs, and in particular of rolls of paper used in the printing industry and graphic arts.

BACKGROUND AND SUMMARY OF THE INVENTION

The invention relates more particularly to an unwinding device comprising an accumulator magazine for the splicing of the ends of two successives rolls without necessitating a material length of stopping time, and without a need of re-passing one end of a web in a pulley path which will be long and difficult to access.

The invention also provides means for making a simultaneous edge to edge cut and gluing of the ends of two webs that are unrolled from two successive rolls.

The invention provides improvment to existing apparatus by making it unnecessary to manually introduce a mandrel inside the rolls, and the invention permits complete operation of the process by means of mechanical components. Additionally, when the web or sheet is up-wound from a roll, a spindle, that supports the roll, is itself supported at both ends, thereby ensuring a great stability to the unrolling process.

According to the invention, the device for positioning and splicing rolls of paper sheets and the like comprises at least one carriage arranged to be movable along guiding means, said carriage having one side comprising an upright provided with slide members for guiding a second carriage that is axially movable along the upright, said second carriage being provided with a spindle engaged in a roll that is raised by a movement of the spindle protruding from said roll to be engaged by a movement of the carriage in a rotary coupling element that is fixedly mounted so that said spindle is supported at both ends when the sheet or web that is unwound from a roll is passed in a pulley path.

Various other features of the invention will be revealed from the following detailed description.

BRIEF DESCRIPTION OF THE DRAWINGS

An embodiment of the invention is shown as a non-limitating example, in the accompanying drawings wherein.

DESCRIPTION OF A PREFERRED EMBODIMENT

Figure 1:
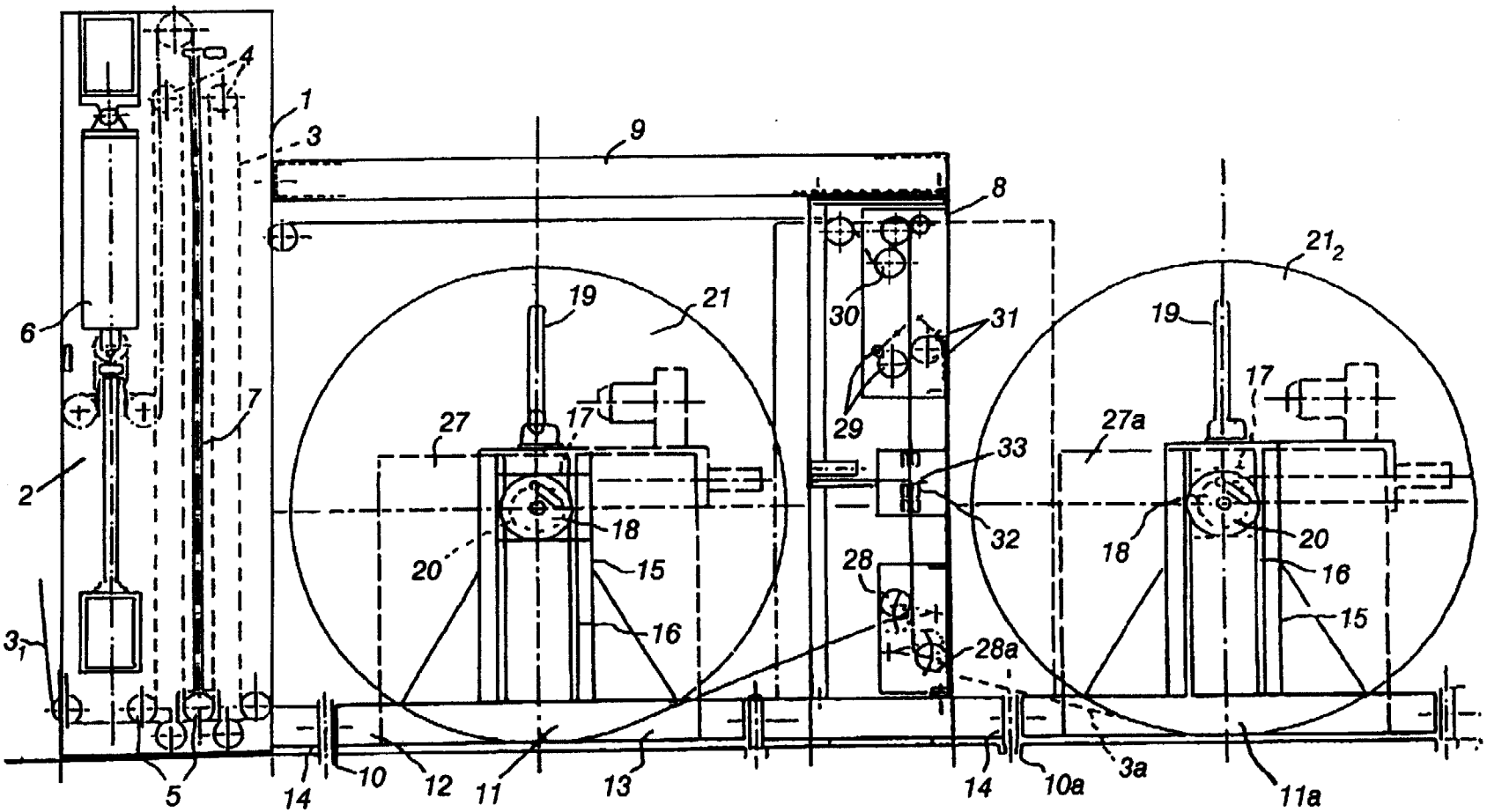
FIG. 1 is a diagrammatic elevational view of the device for the positioning and splicing of rolls of sheets according to the invention.

Referring now more particularly to the drawings, the device as shown comprises a frame 1 inside of which is arranged an accumulator magazine 2 for a web 3 formed for example by a sheet of paper rolled around a set of pulleys 4, 5 that are part of a pulley path and arranged like tackle-blocks that are maintained under a constant tension by means of a jack 6, a counterweight system or the like. The pulleys 5 are movable along a guide 7 so that the web or sheet passing on the pulleys constitutes a reserve.

The main frame 1 is connected to a secondary frame 8 through a beam 9 or any other means providing a suitable rigidity of the frames, one relative to the other.

The gap between the main frame 1 and the secondary frame 8 comprises one guiding means 10, for example a set of rails preferably encased in the ground for a carriage 11 that advantageously comprises two longitudinal girders 12 connected together by a cross member 13 for making a U-shaped chassis carried by a set of wheels 14.

The above chassis supports, by means of its cross member 13, an upright 15 comprising a set of slide members 16 for the guiding of a second carriage 17 movable along the slide members 16 by means of a handling member 18, for example an air-controlled gun for activating a mechanical jack 19 or the like.

The carriage supports a spindle 20 (FIG. 2) on which is engaged a roll 21, typically a paper roll.

The spindle 20 is provided with a locking member 22, for example a mandrel or another air-controlled or mechanical member, for locking together the spindle 20 and the paper roll 21. A fly-wheel **18*a* is used for expanding the mandrel and therefore for the blocking of the roll 21 on the spindle 20**.

Figure 2:
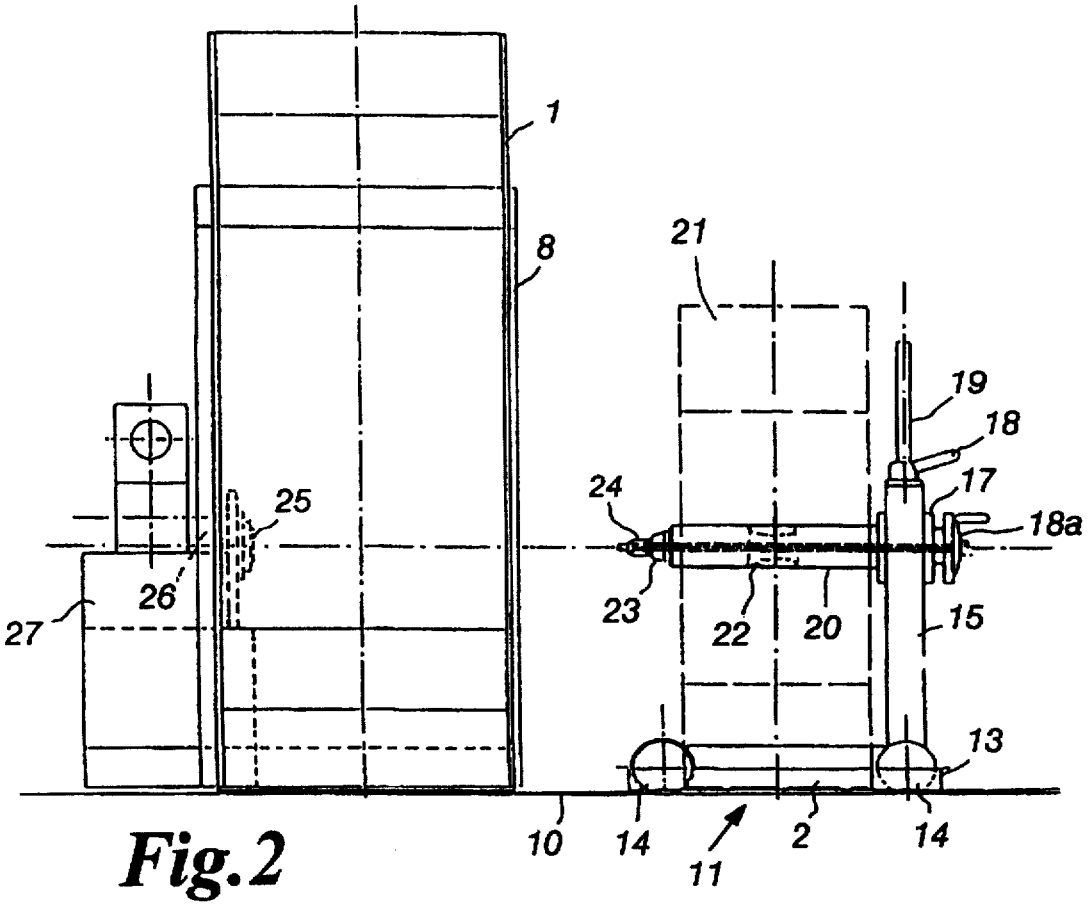
FIG. 2 is an elevational view turned by 90° of the device of FIG. 1, one of the members of the device being shown in a particular position.

As shown in FIG. 2, the cantilevered free end of the spindle 20 protrudes from the roll 21 and has, on its protruding part, a centering cone 23 extended by a driving part 24, having for example a square cross-section, which is adapted to be introduced into a coupling element 25 of a motor shaft 26 protruding from a motor unit 27 that is fixedly mounted and preferably rigidly connected to the main frame 1 and secondary frame 8.

The device comprises two identical carriages 11 and **11*a* for two rolls 21, 21*a***.

FIG. 1 shows that motor unit **27*a*, similar to the motor unit 27, is arranged beyond the secondary frame 8 on a set of rails or other guiding means 10*a*** that are also encased in the ground.

The sheet 3, that is un-wound from the roll 21, passes by a pulley path comprising a capstan 28 as well as retaining and returning guiding pulleys respectively 29 and 30 leading to the pulleys of the accumulator magazine 2.

In a similar manner, the web **3*a* that is un-wound from the roll 21*a*, passes on a capstan 28*a* and retaining pulleys 31 that maintain this web 3*a* on the web 3** on a part of its path.

Gluing and cutting members 32, 33, which are known per se, are arranged on the part of the un-wound webs that are joined side by side one to the other for enabling their connection at end of the unwinding of successive rolls.

The device as disclosed operates as follows:

A first roll, for example the roll 21, is brought by causing it to rotate on the ground or by moving it by an other means in front of one of the carriages, for example the carriage 11, when the carriage 11 is spaced from the frames 1 and 8. The carriage 11 is then moved forward after adjustment in height of the spindle 20 by means of the handling member 18 for bringing it to coincide with the mandrel of the roll. Rotating the roll 21 on the ground is facilitated by the encasing of the set of rails.

The handling member 18 is again activated for moving the spindle 20 in a direction for which the spindle 20 raises the roll 21 which is then locked in position by the locking means 22.

The carriage 11 is then moved again for bringing the carriage 11 between the frames 1 and 8 by causing the driving part 24 to enter the coupling element 25. The centering cone 23 provides also to accurately maintain the free end of the spindle 20 which is thus suspended, on the one hand to the carriage 17 and, on the other hand, to the coupling element 25, comprising a suitable bearing (not shown). Both ends of the spindle 20 are thus rotatably supported.

The outer sheet or web of the roll 21 is then caused to pass around the capstan 28 and around the pulleys 29, 30, and then around the pulleys 4, 5 of the accumulator magazine 2 to be conducted, as shown at 31, to a device where the sheet or web is used.

The second carriage 11*a* is similarly loaded by means of the roll 21*a* and is moved so that the spindle 20 of the second carriage 11*a* is connected to the corresponding coupling element 25 of the motor unit 27*a*.

The web 3*a* from the roll 21*a* is passed around the capstan 28*a* and around the guiding pulleys 31 that correspond to the pulleys 29 followed by the web 3. The process for positioning the roll 21*a* and therefore the web 3*a* can be made during the use of the web 3 that is un-wound from the roll 21.

When the roll 21 comes to its end, the web 3 is braked by the motor driving the hub 25 and spindle 21, down to a full stop.

The unrolling device 30 is then locked, by means of an electromagnetic brake (not shown) for example in order to maintain the full stop.

During this time, the web 31 continue to be attracted by the machine, which machine is then fed by the reserve of the accumulator magazine 2.

The two webs of the finished roll 21 and of the new roll 21*a*are then simultaneously cut by the cutting member 33, and then glued together by means of two adhesive tapes prepared on jaws of the gluing member 32.

The device 30 is then freed, and the new roll is accelerated until the filling of the accumulator magazine 2.

A new roll 21 can be positioned as above mentioned.

As it results from the above disclosure, the accumulator magazine 2 provides to use, without length of stopping time, the web contained therein by moving the pulleys upon immobilization of the ends of webs coming from either one of the rolls 21 or 21*a*.

It should be noted that in some applications, the coupling element 25 can be carried by a free bearing when the unwinding of the rolls is provided by the use of capstans or other similar means. Samely, when it is not necessary to provide a continuous working, the device may comprise only one carriage 11 for a single roll 21. In this latter case, a brake is provided for temporarily stopping the end of the web, for example at the capstan 28.

What is claimed is:

1. A device for positioning and splicing rolls of paper sheet, comprising at least one first carriage arranged to be movable along guiding means, said carriage having one side comprising an upright provided with slide members, a second carriage that is axially movable along the upright and guided thereby, said second carriage being provided with a spindle having a first end and a second end, said first end engaging and being supported by second carriage, said spindle being engagable in a roll, means for raising said roll by a movement of the spindle, said second end of said spindle being engagable by a movement of said second carriage into a rotary coupling element, said rotary coupling element being fixedly mounted so that said spindle is supported at both ends when the sheet is un-wound from a roll thereon, and a motor unit connected to said coupling element for driving said spindle.

2. Device as set forth in claim 1, wherein the coupling element comprises a rotary bearing.

3. Device as set forth in claim 1, wherein the spindle is connected to the coupling element by means of a centering cone and a driving part.

4. Device as set forth in claim 1, wherein the sheet that is un-wound from the roll is caused to pass, by means of capstans and returning pulleys, in a gluing and cutting member and is then conducted to pulleys of an accumulator magazine.

5. Device as set forth in claim 1 and comprising two identical first carriages for two rolls, each of said first carriages being successively activated by movement of said second carriage along their respective guiding means for successive introduction of its spindle into a roll, raising said roll, moving said carriage to said coupling element, and introducing said spindle into said coupling element.

6. Device as set forth in claim 1 wherein the carriage comprises two longitudinal girders connected by a single cross member, whereby said carriage is movable on its guiding means for introducing the spindle into the roll that rests on the ground.

7. Device as set forth in claim 1, wherein said at least one carriage is guided by a rolling path, said rolling path comprising a set of rails encased in the ground.

8. A device for positioning and splicing rolls of paper sheets, comprising at least one first carriage arranged to be movable along guiding means, said carriage having one side comprising an upright provided with slide members, a second carriage that is axially movable along the upright and guided thereby, said second carriage being provided with a spindle having a first end and a second end, said first end engaging and being supported by second carriage, said spindle being engagable in a roll, means for raising said roll by a movement of the spindle, said second end of said spindle being engagable by a movement of said second carriage into a rotary coupling element, said rotary coupling element being fixedly mounted so that said spindle is supported at both ends when the sheet is un-wound from a roll thereon, wherein the spindle is connected to the coupling element by means of a centering cone and driving part.

9. Device as set forth in claim 8, wherein the sheet that is un-wound from the roll is caused to pass, by means of capstans and returning pulleys, in a gluing and cutting member and is then conducted to pulleys of an accumulator magazine.

10. Device as set forth in claim 8 further comprising an additional and identical first carriage, whereby said identical first carriages are arranged for handling of two rolls, each of said first carriages being successively activatable by movement of said second carriage along the respective guiding means for successively introducing each spindle into a roll, raising such roll, moving said carriage to said coupling element, and introducing said spindle into said coupling element.

11. Device as set forth in claim 8, wherein the carriage comprises two longitudinal girders connected by a single cross member, whereby said carriage is movable on its guiding means for introducing the spindle into the roll that rests on the ground.

12. Device as set forth in claim 8, wherein said at least one carriage is guided by a rolling path, said rolling path comprising a set of rails encased in the ground.

13. Device as set forth in claim 8, wherein the coupling element comprises a rotary bearing.

* * * * *